US008171712B2

(12) United States Patent
Hsu et al.

(10) Patent No.: US 8,171,712 B2
(45) Date of Patent: May 8, 2012

(54) MULTI-LAYER YARN STRUCTURE AND METHOD FOR MAKING THE SAME

(75) Inventors: Chih-Chang Hsu, Taipei (TW); Chien-Chung Chen, Taipei (TW)

(73) Assignee: Ruentex Industries Limited, Taipei (TW)

( * ) Notice: Subject to any disclaimer, the term of this patent is extended or adjusted under 35 U.S.C. 154(b) by 103 days.

(21) Appl. No.: 12/771,148

(22) Filed: Apr. 30, 2010

(65) Prior Publication Data

US 2010/0275567 A1 Nov. 4, 2010

(30) Foreign Application Priority Data

May 4, 2009 (TW) ..... 98114756 A

(51) Int. Cl.
*D02G 3/02* (2006.01)

(52) U.S. Cl. ..... 57/224

(58) Field of Classification Search ..... 57/224
See application file for complete search history.

(56) References Cited

U.S. PATENT DOCUMENTS 4,428,752 A * 1/1984 Goldenstein ..... 8/529
4,958,485 A * 9/1990 Montgomery et al. ..... 57/210
5,514,457 A * 5/1996 Fels et al. ..... 442/191
5,568,719 A * 10/1996 Proctor ..... 57/225
2004/0121150 A1* 6/2004 Johnson et al. ..... 428/364

FOREIGN PATENT DOCUMENTS

| | | | |
|---|---|---|---|
| JP | 02-014032 | A | 1/1990 |
| JP | 04-091240 | A | 3/1992 |
| JP | 10-110342 | A | 4/1998 |
| JP | 11-172539 | A | 6/1999 |
| JP | 2004-169223 | A | 6/2004 |
| JP | 2004-176218 | A | 6/2004 |
| JP | 2004-308036 | A | 11/2004 |
| TW | M328457 | | 3/2008 |
| TW | I297051 | | 5/2008 |

* cited by examiner

*Primary Examiner* — Shaun R Hurley
(74) *Attorney, Agent, or Firm* — Cheng-Ju Chiang

(57) ABSTRACT

A multi-layer yarn structure and a method for making the same are provided. The multi-layer yarn structure includes a core layer, a layer of noncircular fibers, and an outer layer. The core layer has a plurality of hydrophobic fibers. The noncircular fibers surround the core layer to form a middle layer. The outer layer surrounds the middle layer and has a plurality of hydrophilic fibers. The method spins different fibers into multi-layer yarn for making textile with a soft, smooth, and thick feel. By utilizing inherent characteristics of the multi-layer yarn structure, the textile may regulate moisture released from the human body and keep the body dry and comfort.

15 Claims, 6 Drawing Sheets

MULTI-LAYER YARN STRUCTURE AND METHOD FOR MAKING THE SAME

CROSS REFERENCE TO RELATED APPLICATIONS

This application claims priority based on a Taiwanese patent application No. 098114756 filed on May 4, 2009, the disclosure of which is incorporated herein by reference in its entirety.

BACKGROUND OF THE INVENTION

1. Field of the Invention

The present invention relates to a multi-layer yarn structure. More particularly, the present invention relates to a multi-layer yarn structure capable of achieving moisture management to remove perspiration away from the skin.

2. Description of the Prior Art

Due to the increasing demands of functional textiles/fabrics, the textile manufacturers not only focus on increasing additional value and practicability of textiles, but also intend to lead the fashion trend and develop all kinds of multi-functional textiles. Among all, moisture management or water transport property is one of primary standards for functional textiles.

Textiles with moisture management/water transport properties can absorb moisture of human bodies into the surface of the textile and then release the moisture to the atmosphere. In other words, textiles with moisture management/water transport properties exhibit the function of transporting sweat and moisture on the surface of skin to the surface of the clothing, thus preventing sweat from remaining on the skin, so as to keep the body dry and comfort. Moreover, in cold weather, the moisture management textiles can prevent heat loss of human body caused by evaporation of large amount of sweat.

According to conventional textiles having moisture transport properties, moisture and sweat are removed away from the skin by wicking, diffusion, and transmission processes via micro slits on the fibers and then diffused and evaporated quickly via the fibers of the clothing, so as to keep the skin dry and comfort and regulate the body temperature. As described above, due to the capillary or wicking phenomenon, the thinner the capillary is, the better the moisture absorption efficiency can be achieved. Therefore, fibers having numerous thin capillaries are desirable for excellent moisture absorption efficiency. Furthermore, when the moisture absorption efficiency of the fibers is better, the moisture absorption efficiency of the textile is increased. Therefore, the moisture absorption efficiency affects the comfort of the clothing. In the case that the moisture absorption and release efficiencies are better, the drying speed is faster and makes the skin more comfortable.

As the textiles quickly absorb moistures, it is possible to adjust the body temperature, improve vitality of body muscles, and delay fatigue. The textiles with good moisture transport properties are usually made from polyamide (PA) or polyester (PET). These textiles have light weight, absorb moisture/sweat quickly, and remove the moisture from the clothing rapidly.

However, the conventional textiles or fabrics with moisture transport properties are made by specific processing methods, e.g., adding chemicals to change the chemical structure of the surface of the fibers, or using mixed fibers for improving the moisture transport properties. As an example, the conventional push-pull fiber is a two-layer-yarn-structure consisting of a core layer which does not absorb moisture and a surface layer which can absorb moistures. That is, the surface layer absorbs moisture and sweat on the surface of skin, and then the core layer removes the moisture and sweat to keep the skin comfort and dry.

Therefore, in order to prevent the use of a great amount of chemical solvents and achieve other requirements, a new yarn structure is desirable.

SUMMARY OF THE INVENTION

It is an objective of the present invention to provide a multi-layer yarn structure and a method for making the same which is capable of regulating moisture released by human bodies and keeping the skin comfort and dry.

It is another objective of the present invention to provide a multi-layer yarn structure and a method for making the same, such that the composite yarn has a soft, smooth, and thick feel.

It is a further objective of the present invention to provide a multi-layer yarn structure and a method for making the same, which minimizes the use of chemical solvents to achieve the moisture transport properties.

It is yet another objective of the present invention to provide a multi-layer yarn structure and a method for making the same, so as to control humidity.

It is another objective of present invention to provide a multi-layer yarn structure and a method for making the same, wherein the fibers are micro-porous, and the moisture can be transported quickly.

The present invent provides a multi-layer yarn structure includes a core layer, a middle layer, and an outer layer. The core layer has a plurality of hydrophobic fibers; the hydrophobic fiber includes a hydrophilic fine denier fiber which has a fineness less than 75 denier. A plurality of noncircular fibers surrounds the core layer to form the middle layer while the outer layer surrounds the middle layer. Particularly, the core layer including a plurality of hydrophilic fibers is surrounded by the middle layer to form a three layer yarn structure as the multi-layer yarns structure.

In an exemplary embodiment, each noncircular fiber preferably has a crisscross shape; in other embodiments, however, the noncircular fiber may include Y-shape, cinquefoil shape, W-shape, micro porous structure or other proper shapes. The noncircular fibers preferably have better moisture transport properties and quicker moisture evaporation characteristic to regulate human body moisture rapidly. The material of the noncircular fibers includes artificial fibers and/or natural fibers. The artificial fiber may include polyester/polyethylene terephthalate (PET), polyamide 6 (PA6), polyamide 66 (PA66), nylon 6, nylon 66, polypropylene (PP), polyolefin, regenerated cellulose fibers (rayon, Tencel, Modal rayon, Tencel Sun) or other proper fibers. The nature fiber may include cotton, wool, flax, jute, ramie, sheng ma, hemp, or other proper fibers.

The present invention further provides a method for making a multi-layer yarn structure including the steps of: providing a plurality of hydrophobic fibers to form a core layer routing through a front roller of a first spinning area; conveying a plurality of noncircular fibers to the front roller of the first spinning area to overlap the core layer and wrapping the noncircular fibers around the core layer to form a semi-finished yarn; conveying the semi-finished yarn to a front roller of a second spinning area; and providing a plurality of hydrophilic fibers to the front roller of the second spinning area to overlap the semi-finished yarn and wrapping the hydrophilic fibers around the semi-finished yarn to form the multi-layer yarn.

In a preferred embodiment, conveying the noncircular fibers to the front roller of the first spinning area includes overlapping the noncircular fibers and the core layer in parallel and then rotating to form a composite yarn. In this step, before rotating the noncircular fibers, the method further includes conveying the noncircular fibers and the core layer to a twisting point of the first spinning area, by rotating the twisting point of the first spinning area to wrap the noncircular fibers around the core layer to form the composite yarn. In addiction, providing the hydrophilic fibers to a front roller of the second spinning area further includes overlapping the hydrophilic fibers and the semi-finished yarn in parallel and then rotating to form a three-layer yarn. In this step, before rotating the hydrophilic fibers, the method further includes conveying the hydrophilic fibers and the semi-finished yarn to a twisting point of a second spinning area, by rotating the twisting point of the second spinning area to wrap the noncircular fiber around the semi-finished fiber to form the three-layer yarn.

DETAILED DESCRIPTION OF THE PREFERRED EMBODIMENT

The present invention provides a multi-layer yarn structure and a method for making the same which is capable of quick-drying and absorbing moisture to keep wearers comfort. In a preferred embodiment, the multi-layer structure includes three layer yarns and consists of hydrophobic fibers, noncircular fibers, and hydrophilic fibers. In general, the three-layer yarn structure preferably includes three different materials overlapping with each other to form the yarn structure. However, the number of layers or cycles of each yarn structure is not limited to the invention. In order to illustrate the present invention, various embodiments and structures thereof are described below with reference to the accompanied drawings.

Figure 1:
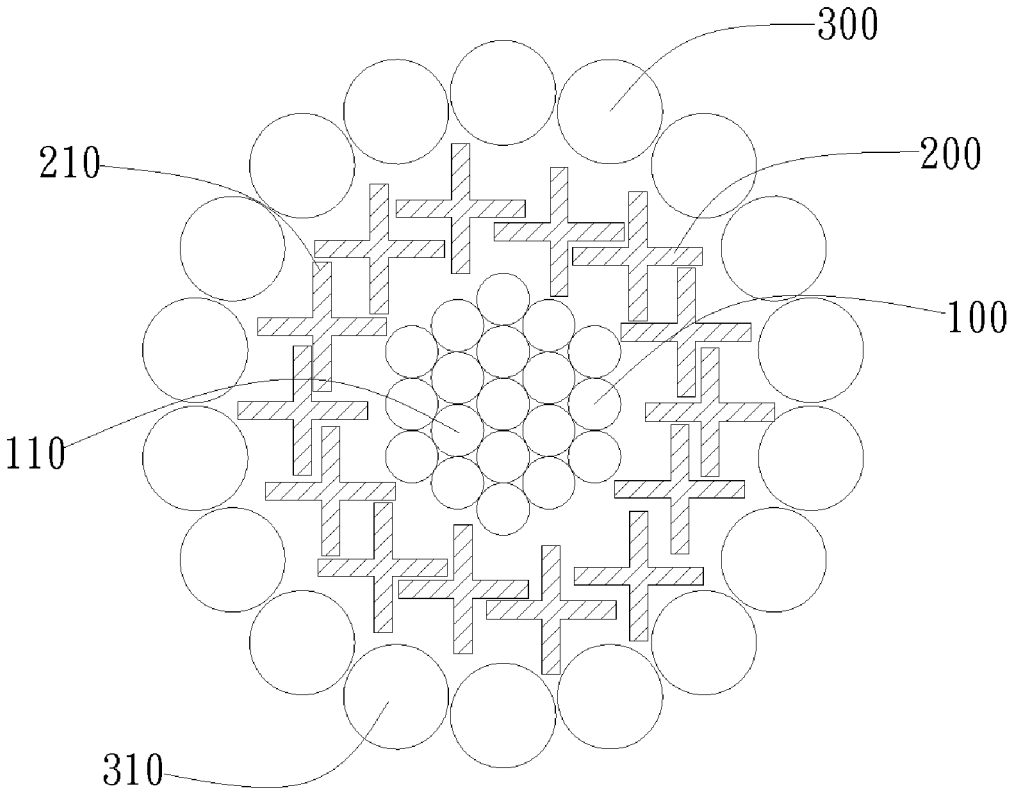
FIG. 1 illustrates a schematic cross-sectional view of a multi-layer yarn structure of the present invention.

As FIG. 1 shows, the multi-layer yarn structure of the present invention includes a core layer 100, a middle layer 200, and an outer layer 300. The core layer 100 has a plurality of hydrophobic fibers 110. The hydrophobic fiber 110 preferably includes a hydrophobic fine denier fiber which includes a single fiber or multiple fibers having a fineness less than 75 denier. In the embodiment shown in FIG. 1, the hydrophobic fiber 110 can be a single bunch of fibers or multiple bunches of fibers to provide the yarn with better mechanical strength, such as tensile strength, etc. and in turn to achieve a high tenacity yarn. The material of the hydrophobic fiber 110 is preferably polyester/polyethylene terephthalate (PET). In other embodiments, however, the hydrophobic fiber 110 may include polyamide 6 (PA6), polyamide 66 (PA66), nylon 6, nylon 66, polypropylene (PP), polyolefin, or other proper fibers.

Figure 2:
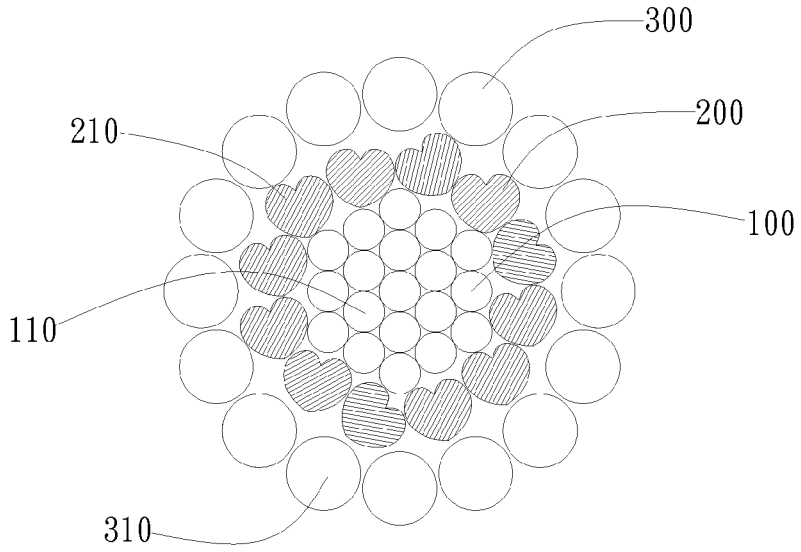
FIG. 2 illustrates another embodiment of a noncircular fiber of the present invention.
Figure 3:
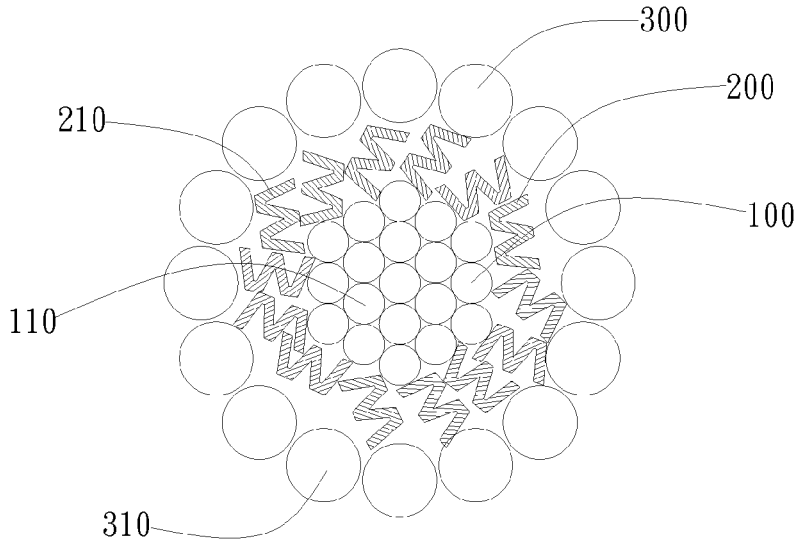
FIG. 3 illustrates yet another embodiment of the noncircular fiber of the present invention.

The middle layer 200 surrounds the core layer 100 with a plurality of noncircular fibers 210. In the embodiment, the shape of each noncircular fiber 210 is preferably a crisscross shape. As FIG. 2 or FIG. 3 shows, however, the noncircular fiber 210 may include heart shape, W-shape, Y-shape, cinquefoil shape, micro porous structure, such that coolplus, or other proper shapes.

Due to the cross-section of the noncircular fiber 210 is a crisscross shape and its specific surface ($m^2/g$) is relatively large while its fiber surface has numerous fine holes, the noncircular fiber 210 may use the capillarity effect to release the moisture to the atmosphere from the skin and keep the body dry and comfort. Moreover, the material of the noncircular fiber 210 may include artificial fibers and/or natural fibers. The artificial fiber may include polyester/polyethylene terephthalate (PET), polyamide 6 (PA6), polyamide 66 (PA66), nylon 6, nylon 66, polypropylene (PP), polyolefin, or other proper fibers. The nature fiber may include cotton, wool, flax, jute, ramie, sheng ma, hemp, or other proper fibers.

The outer layer 300 consists of a plurality of hydrophilic fibers 310 surrounding the middle layer 200; thus, the three-layer yarn structure is formed. The hydrophilic fiber 310 is preferably a nature fiber or cellulose fiber, such as cotton fiber, wool fiber, jute fiber, ramie fiber, flax fiber, sheng ma fiber, hemp fiber, cupra rayon fiber, viscose rayon fiber, tencel, modal rayon, tencel sun, bamboo fiber, cellulose acetate fiber, acetate fiber, or regenerated cellulose fiber.

In the embodiment of FIG. 1, the first layer of the three-layer yarn structure, i.e. the core layer 100, preferably contains non-absorbent PET fibers to provide the yarn with greater elastic extensibility. The second layer of the three-layer yarn structure, i.e. the middle layer 200, is preferably noncircular PET fibers and its moisture regain (index of moisture present in a material, expressed as a percentage of the moisture-free weight, as determined under definite prescribed conditions) is below 0.4%. The third layer of the three-layer yarn structure, i.e. the hydrophilic fiber 310 of the outer layer 300, is preferably cotton and its moisture regain is 8%. In other embodiments, however, the three-layer yarn structure may be constructed in a manner that the core layer 100 serves as the first layer, the hydrophilic fiber 310 serves as the second layer, and the crisscross shape PET fiber serves as the third layer. The material of each layer is set forth as above and can be modified depending on the required functionality.

Figure 4:
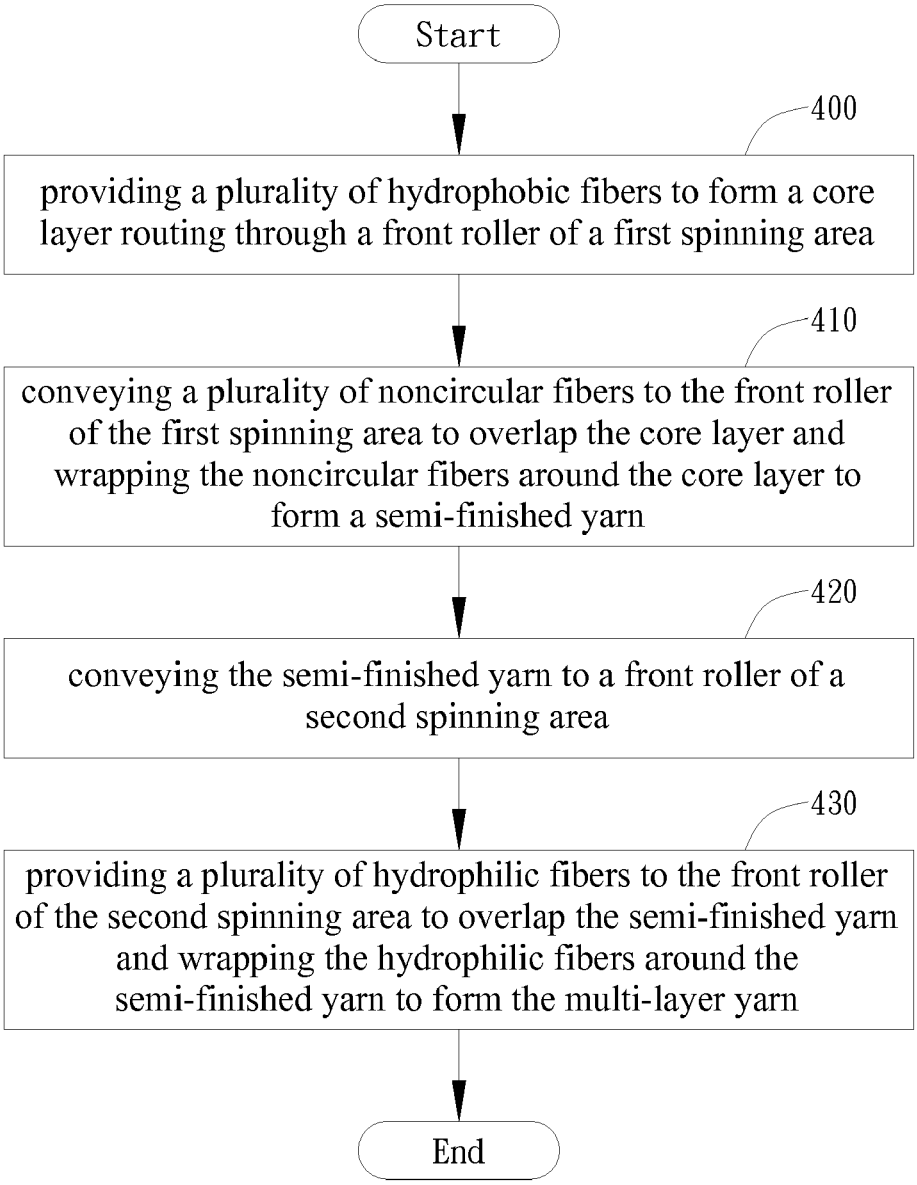
FIG. 4 shows a flow chart of a method of making the multi-layer yarn structure of the present invention.

As FIG. 4 shows, the present invention further provides a method of making a multi-layer yarn structure including: a step 400 of providing a plurality of hydrophobic fibers to form a core layer routing through a front roller of a first spinning area, a step 410 of conveying a plurality of noncircular fibers to the front roller of the first spinning area to overlap the core layer and wrapping the noncircular fibers around the core layer to form a semi-finished yarn, a step 420 of conveying the semi-finished yarn to a front roller of a second spinning area, and a step 430 of providing a plurality of hydrophilic fibers to the front roller of the second spinning area to overlap the semi-finished yarn and wrapping the hydrophilic fibers around the semi-finished yarn to form the multi-layer yarn.

In the embodiment of FIG. 4, in the step 410, before conveying the noncircular fibers to the front roller of the first spinning area, the method further includes overlapping the noncircular fibers and the core layer in parallel and then rotating to form a composite yarn. In addition, before rotating the noncircular fibers, the method further includes conveying each noncircular fiber and the core layer to a twisting point of the first spinning area, by rotating the twisting point of the first spinning area to wrap each noncircular fiber around the core layer to form the composite yarn. In step 430, before providing the hydrophilic fibers to the front roller of the second spinning area, the method further includes overlapping the hydrophilic fibers and the semi-finished yarn in parallel, and then rotating to form a three-layer yarn. Moreover, before rotating the hydrophilic fibers, the method further includes conveying the hydrophilic fibers and the semi-finished yarn to the twisting point of the second spinning area, by rotating the twisting point of the second spinning area to wrap the noncircular fiber around the semi-finished fiber to form the three-layer yarn.

Figure 5A:
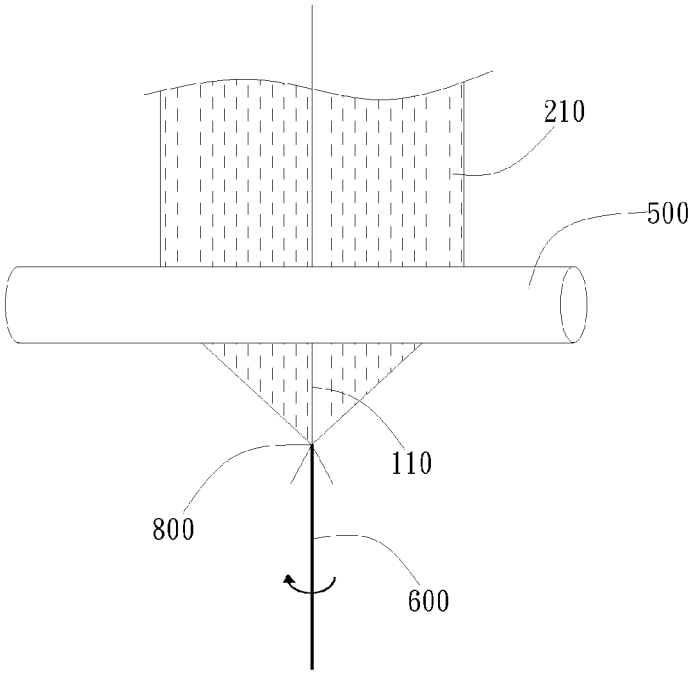
FIG. 5A illustrate a first embodiment of a method of making the multi-layer yarn structure of the present invention.
Figure 5B:
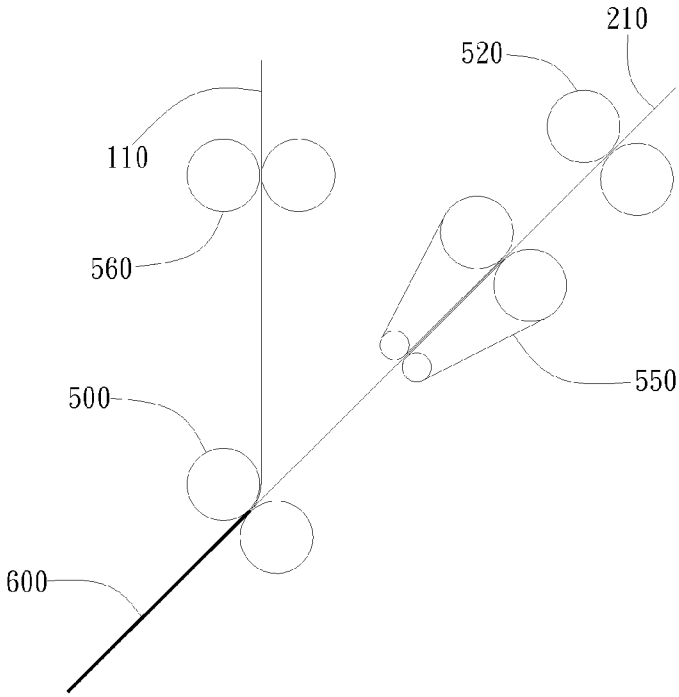
FIG. 5B illustrates a side view of FIG. 5A.
Figure 6A:
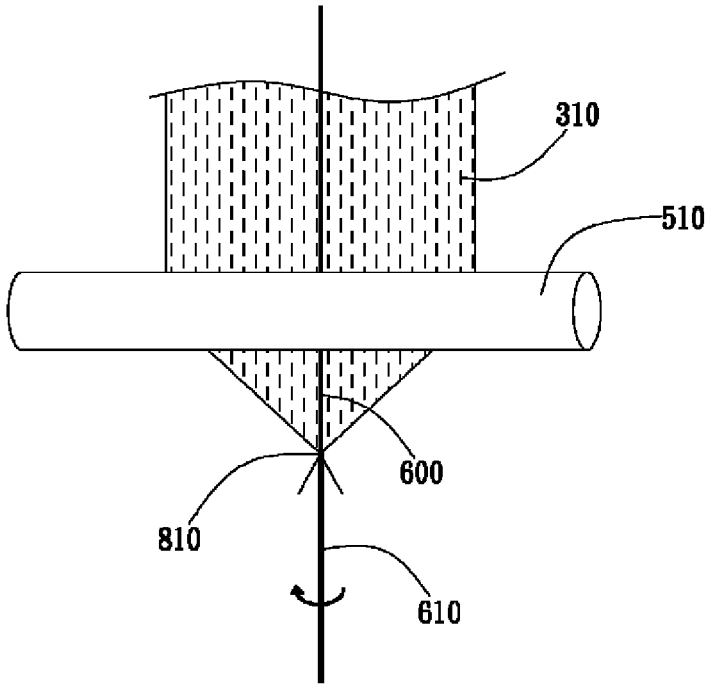
FIG. 6A illustrates a second embodiment of the method of making the multi-layer yarn structure of the present invention.
Figure 6B:
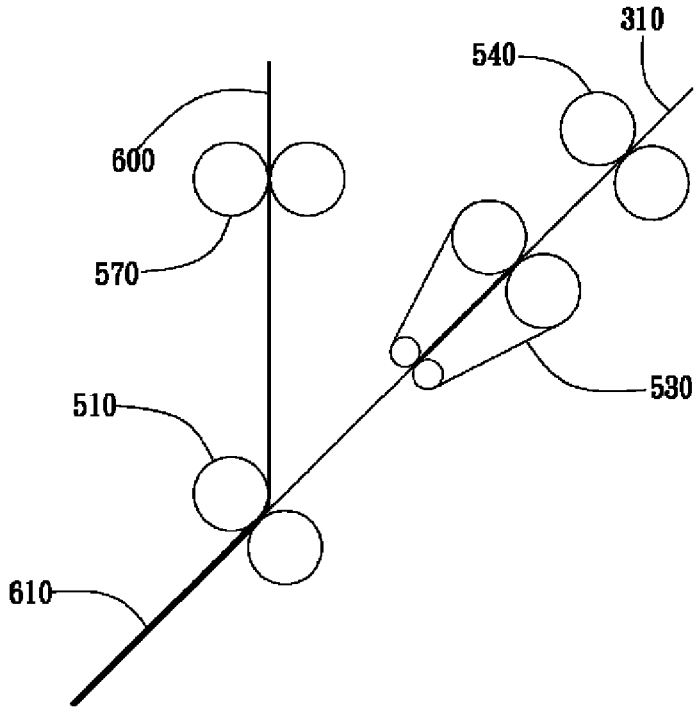
FIG. 6B illustrates a side view of FIG. 6A.

Hereinafter, the method for making the multi-layer yarn structure will be described with reference to the process equipment, wherein FIGS. 5A and 6A illustrate front views of the process equipment, and FIGS. 5B and 6B illustrate side views of the process equipment.

As FIGS. 5A and 5B show, the hydrophobic fibers 110 and the noncircular fibers 210 are preferably overlapped with each other and wrapped together after providing/conveying the two different fibers through the front roller 500 of the first spinning area. Moreover, before routing through the front roller 500 of the first spinning area, the hydrophobic fiber 110 and the noncircular fiber 210 are conveyed by distinct guiding devices in different routes, as shown in FIG. 5B. In the embodiment shown in FIG. 5B, the guiding device for conveying the noncircular fibers 210 includes three sets of extendable rollers 500, 520, and 550 to extend and align each noncircular fiber. In order to control the spinning requirement of the yarn, the speed of the guiding devices can be adjusted. For example, in this stage, the twist multiplier (T.M., T.M.=Twist per inch÷√yarn count) and the yarn ratio is preferably 1.5~4. In other embodiments, the T.M. may be more than 4, and the guiding device for conveying the noncircular fibers 210 may include more than three sets of extendable rollers, depending on the demand. Furthermore, two sets of guiding devices can be employed to convey the hydrophobic fibers 110; in addition to the front roller 500 of the first spinning area, a stable guiding roller 560 is provided to ensure the yarn to have steady tensional force and control the feeding position of the hydrophobic fibers 110. Therefore, by means of the stable guiding roller 560, the hydrophobic fibers 110 and the noncircular fibers 210 are routed and twisted through a twisting point 800 of the first spinning area to ensure the hydrophobic fiber 110 stably warped by the noncircular fiber 210 to form the semi-finished yarn 600, as shown in FIG. 5A.

After the semi-finished yarn 600 is formed, the semi-finished yarn 600 is conveyed to the front roller 510 of the second spinning area, as shown in FIGS. 6A and 6B. In the embodiment shown in FIGS. 6A and 6B, the hydrophilic fibers 310 are also routed through the front roller 510 of the second area to overlap the semi-finished yarn 600. Before this operation, the semi-finished yarns 600 and the hydrophilic fibers 310 are conveyed by distinct guiding devices in different routes, as shown in FIG. 6B. In the embodiment shown in FIG. 6B, the guiding devices for conveying the hydrophilic fibers 310 includes three sets of extendable rollers 510, 530, and 540 to extend and align each hydrophilic fiber 310. In order to control the spinning requirement of the yarn, the speed of the guiding devices can be adjusted. For example, in this stage, the twist multiplier and its yarn ratio is preferably be 2~4.5. In other embodiments, however, the T.M. may be more than 4.5, and the guiding devices for conveying the hydrophilic fibers 310 may include more than three sets of extendable rollers, depending on the demand. Furthermore, two sets of guiding devices can be employed to convey the semi-finished yarn 600; in addition to the front roller 510 of the second spinning area, a stable guiding roller 570 is provided to ensure the yarn to have steady tensional force and control the feeding position of the semi-finished yarn 600. Therefore, by means of the stable guiding roller 570, the semi-finished yarn 600 and the hydrophilic fibers 310 are routed and twisted through a second twisting point 810 of the second spinning area to ensure the semi-finished yarn 600 stably warped by the hydrophilic fiber 310 to form the multi-layer yarn 610, as shown in FIG. 6A.

It is noted that, in this embodiment, though a respective equipment of different spinning area is employed to make the semi-finished yarn 600 and the multi-layer yarn 610. In other embodiment, however, the same equipment can be employed to make the semi-finished yarn 600 and the multi-layer yarn 610. In other words, the front roller 510 and the twisting point 810 of the second spinning area may be replaced by the front roller 500 and the twisting point 800 of the first spinning area, and the stable guiding roller can be used replaced as well. In such a case, only the CTF has to be adjusted depending on whether the semi-finished yarn 600 or the multi-layer yarn 610 to be formed. Moreover, the thickness of the semi-finished yarn 600 or the multi-layer yarn 610 can be controlled by controlling the rotation speed (rpm) of the twisting point 800 and the speed (cm/sec) of the front roller 500 of the first spinning area or the rotation speed (rpm) of the twisting point 810 of the second spinning area and the speed (cm/sec) of the front roller 510 of the second spinning area. On the other hands, when the rotation speed of the twisting point 800 of the first spinning area or the twisting point 810 of the second spinning area is constant, the conveying speed of the front roller 500 of the first spinning area or the front roller 510 of the second spinning area is increased faster, the thickness of semi-finished yarn 600 or the multi-layer yarn 610 becomes thicker.

Figure 7:
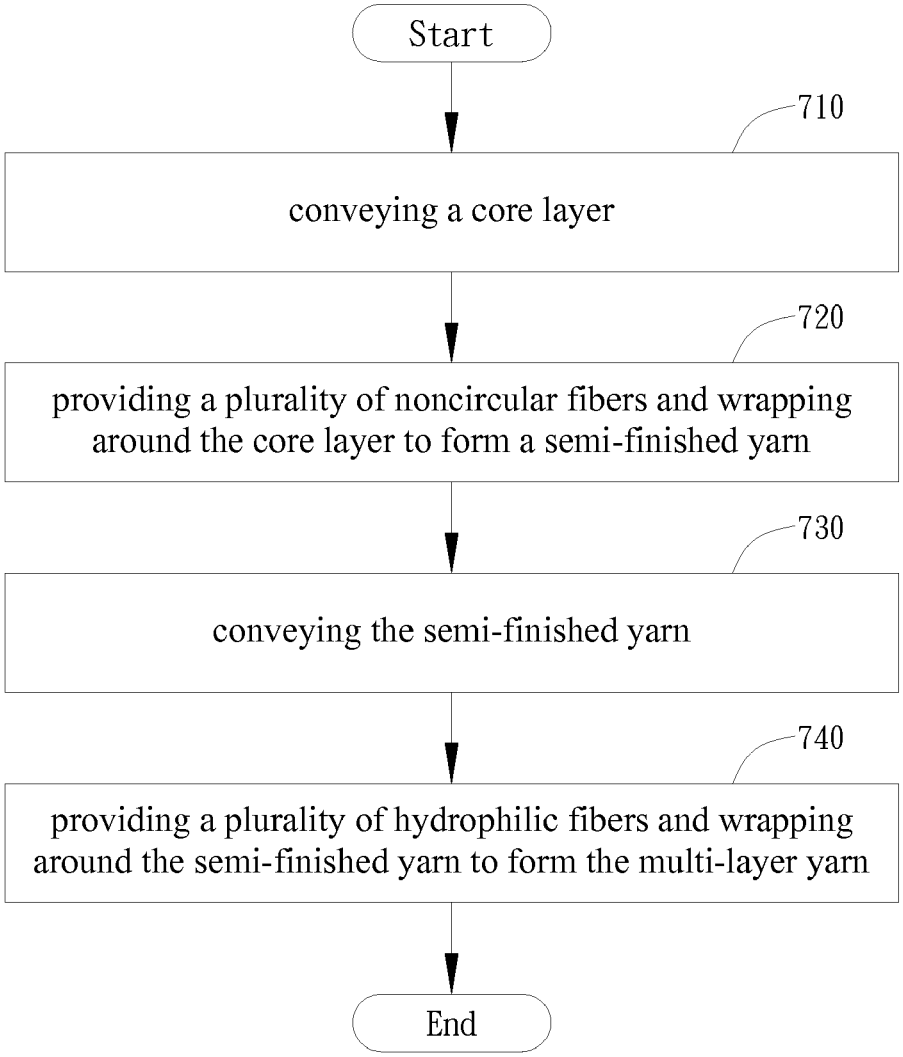
FIG. 7 shows another flow chart of the method of making the multi-layer yarn structure of the present invention.

As FIG. 7 shows, the present invention further provides a method of making the multi-layer yarn structure including the steps of: a step 710 of conveying a core layer, a step 720 of providing a plurality of noncircular fibers and wrapping around the core layer to form a semi-finished yarn, a step 730 of conveying the semi-finished yarn, and a step 740 of providing the hydrophilic fiber and wrapping the semi-finished yarn to form a multi-layer yarn.

In step 720, wrapping the core layer to form the semi-finished yarn further includes overlapping each noncircular fiber and the core layer in parallel and then wrapping the core layer. In step 740, wrapping the semi-finished yarn to form the multi-layer yarn further includes overlapping each hydrophilic fiber and the semi-finished yarn in parallel and then wrapping the semi-finished yarn.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A multi-layer yarn structure comprising a core layer having a plurality of hydrophobic fibers; a plurality of noncircular fibers surrounding the core layer to form a middle layer; and an outer layer surrounding the middle layer, wherein the outer layer has a plurality of hydrophilic fibers, and a surface of the noncircular fiber has numerous fine holes, so that the noncircular fiber produces capillarity effect.

2. The multi-layer yarn structure of claim 1, wherein each of the hydrophobic fibers includes a hydrophobic fine denier fiber.

3. The multi-layer yarn structure of claim 2, wherein the hydrophobic fine denier fiber includes a fiber having a fineness less than 75 denier.

4. The multi-layer yarn structure of claim 1, wherein the hydrophobic fiber includes polyester/polyethylene terephthalate (PET), polyamide 6 (PA6), polyamide 66 (PA66), nylon 6, nylon 66, polypropylene (PP), or polyolefin.

5. The multi-layer yarn structure of claim 1, wherein the noncircular fiber includes crisscross shape, Y-shape, cinquefoil shape, or W-shape.

6. The multi-layer yarn structure of claim 1, wherein the noncircular fiber includes polyester/polyethylene terephthalate (PET), polyamide 6 (PA6), polyamide 66 (PA66), nylon 6, nylon 66, polypropylene (PP), or polyolefin.

7. The multi-layer yarn structure of claim 1, wherein the hydrophilic fiber includes cotton, wool, flax, jute, ramie, sheng ma, hemp, cupra rayon, tencel, modal rayon, tencel sun, viscose rayon, bamboo fiber, acetate fiber, cellulose acetate fiber, or regenerated cellulose fiber.

8. A method of making a multi-layer yarn, comprising:

providing a plurality of hydrophobic fibers to form a core layer routing through a front roller of a first spinning area;

conveying a plurality of noncircular fibers to the front roller of the first spinning area to overlap the core layer and wrapping the noncircular fibers around the core layer to form a semi-finished yarn, wherein a surface of the noncircular fiber has numerous fine holes, so that the noncircular fiber produces capillarity effect;

conveying the semi-finished yarn to a front roller of a second spinning area; and providing a plurality of hydrophilic fibers to the front roller of the second spinning area to overlap the semi-finished yarn in parallel, and then wrapping the hydrophilic fibers around the semi-finished yarn to form the multi-layer yarn, wherein the multi-layer yarn is a three-layer yarn.

9. The method of claim 8, wherein conveying the noncircular fibers to the front roller of the first spinning area includes overlapping the noncircular fibers and the core layer in parallel and then rotating to form a composite yarn.

10. The method of claim 9, before rotating the noncircular fibers, further including conveying the noncircular fibers and the core layer to a twisting point of the first spinning area, by rotating the twisting point of the first spinning area to wrap the noncircular fibers around the core layer to form the composite yarn.

11. The method of claim 10, wherein when the rotation speed of the twisting point of the first spinning area is constant, the speed of the front roller of the first spinning area conveying the noncircular fibers and the core layer is proportional to the thickness of the semi-finished yarn.

12. The method of claim 8, before rotating the hydrophilic fibers, further including conveying the hydrophilic fibers and the semi-finished yarn to a twisting point of a second spinning area, by rotating the twisting point of the second spinning area to wrap the noncircular fiber around the semi-finished fiber to form the three-layer yarn.

13. The method of claim 12, wherein when the rotation speed of the twisting point of the second spinning area is constant, the speed of the front roller of the second spinning area conveying the hydrophilic fibers and the semi-finished fiber is proportional to the thickness of the multi-layer yarn.

14. A method of making a multi-layer yarn, comprising:

conveying a core layer;

providing a plurality of noncircular fibers and wrapping around the core layer to form a semi-finished yarn, wherein a surface of the noncircular fiber has numerous fine holes, so that the noncircular fiber produces capillarity effect;

conveying the semi-finished yarn; and providing a plurality of hydrophilic fibers, overlapping the hydrophilic fiber and the semi-finished yarn in parallel, and then wrapping around the semi-finished yarn to form the multi-layer yarn.

15. The method of claim 14, wherein wrapping the core layer to form the semi-finished yarn further includes overlapping the noncircular fiber and the core layer in parallel and then rotating around the core layer.

* * * * *